US007044485B2

(12) United States Patent
Kent et al.

(10) Patent No.: US 7,044,485 B2
(45) Date of Patent: May 16, 2006

(54) ELASTOMERIC SUSPENSION SYSTEM SKATEBOARD TRUCK

(76) Inventors: Tracy Scott Kent, P.O. Box 60634, San Diego, CA (US) 92166; Michael W. MacCollum, 14188 Woodcreek Rd., Poway, CA (US) 92064

( * ) Notice: Subject to any disclaimer, the term of this patent is extended or adjusted under 35 U.S.C. 154(b) by 0 days.

(21) Appl. No.: 10/605,297

(22) Filed: Sep. 20, 2003

(65) Prior Publication Data

US 2004/0207169 A1 Oct. 21, 2004

(51) Int. Cl.
*A63C 17/00* (2006.01)
*A63C 1/24* (2006.01)
*B62M 1/00* (2006.01)

(52) U.S. Cl. ..... 280/87.042; 280/87.041; 280/11.28; D21/765

(58) Field of Classification Search ..... 280/11.27, 280/11.28, 11.19, 87.042, 87.041, 87.05, 280/842; D21/765, 771; 267/292; A63C 17/01, A63C 17/02
See application file for complete search history.

(56) References Cited

U.S. PATENT DOCUMENTS

| | | | | |
|---|---|---|---|---|
| 2,494,019 | A * | 1/1950 | Ware, Jr. | 280/11.28 |
| 4,159,830 | A * | 7/1979 | Solimine | 280/11.28 |
| 5,114,166 | A | 5/1992 | McCosker | |
| 5,263,725 | A * | 11/1993 | Gesmer et al. | 280/11.28 |
| 5,868,408 | A | 2/1999 | Miller | |
| 5,997,018 | A | 12/1999 | Lee | |
| 6,123,348 | A * | 9/2000 | Miller | 280/87.042 |
| 6,182,987 | B1 * | 2/2001 | Bryant | 280/87.042 |
| D439,945 | S | 4/2001 | Kent | |
| 6,224,076 | B1 * | 5/2001 | Kent | 280/87.042 |
| 6,286,843 | B1 * | 9/2001 | Lin | 280/11.28 |
| 6,299,186 | B1 * | 10/2001 | Kao et al. | 280/87.041 |
| 6,367,819 | B1 * | 4/2002 | Andersen et al. | 280/11.28 |
| 6,382,646 | B1 * | 5/2002 | Shaw | 280/87.041 |
| 6,474,666 | B1 * | 11/2002 | Andersen et al. | 280/87.041 |
| 6,481,725 | B1 * | 11/2002 | Chou | 280/7.14 |
| 6,547,262 | B1 * | 4/2003 | Yamada et al. | 280/11.28 |
| 6,739,603 | B1 * | 5/2004 | Powell | 280/11.27 |
| 6,761,369 | B1 * | 7/2004 | Anderson | 280/87.042 |
| 6,793,224 | B1 * | 9/2004 | Stratton | 280/87.042 |
| 6,863,283 | B1 * | 3/2005 | Houston et al. | 280/11.225 |
| 6,932,362 | B1 * | 8/2005 | Barrett | 280/11.27 |
| 6,945,542 | B1 * | 9/2005 | Stewart | 280/11.27 |
| 2002/0070515 | A1 * | 6/2002 | Barbieri et al. | 280/14.21 |
| 2004/0036243 | A1 * | 2/2004 | Chang | 280/87.042 |

FOREIGN PATENT DOCUMENTS

| | | | | |
|---|---|---|---|---|
| DE | 3829318 | A1 * | 3/1990 | 280/87.042 |

* cited by examiner

*Primary Examiner*—Christopher P. Ellis
*Assistant Examiner*—G B Klebe
(74) *Attorney, Agent, or Firm*—Steven Webb

(57) ABSTRACT

The Elastomer Suspension System Skateboard Truck is proposed for use in all styles of skateboarding. This new design is unlike any conventional skateboard truck. The truck incorporates an elatomer suspension system, which is a modification of the type used in automotive vehicles and other mechanisms utilizing shock absorbing equipment. The elastomer shock absorbers oppose pressure from end to end, therefore diminishing or eliminating all forces associated with sudden or rapid motions. By downgrading or eradicating these extreme shock forces the skateboarder has more control, and is therefore more maneuverable.

2 Claims, 4 Drawing Sheets

ELASTOMERIC SUSPENSION SYSTEM SKATEBOARD TRUCK

BACKGROUND OF INVENTION

This skateboard truck is a new configuration of my previously designed skateboard truck the Pneumatic Compression Strut Skateboard Truck, U.S. Pat. No. 6,224,076 as of May 1, 2001. This new devise is an improvement upon the formally patented skateboard truck suspension system technology, by further advancing the balance stability of the skateboard truck. Additionally, the new design consists of a suspension system which includes components that are easily interchangeable, giving the rider the ability to customize the truck response according to their weight and riding ability. This equates to advanced maneuverability with respect to superior steering stability and therefore steering ease.

SUMMARY OF INVENTION

The invention claimed is a skateboard truck intended for use in all categories of general skateboarding. This skateboard truck diverges from traditional skateboard trucks by incorporating an elastomer suspension system.

The suspension system utilizes two shock absorbers, which are bilateral and equidistant between the hanger and base plate of the skateboard truck. These elastomer shock absorbers significantly suppress and eliminate shock forces associated with all styles of skateboarding. This permits more direct movement of the skateboard truck to dramatically enhance guiding stability and therefore guiding control. This design allows customization of truck response with easily interchangeable shock absorbers. Further, the shock absorber design can be produced with a molded or cast process, thus improving the manufacturability of the assembly.

DETAILED DESCRIPTION

Figure 1:
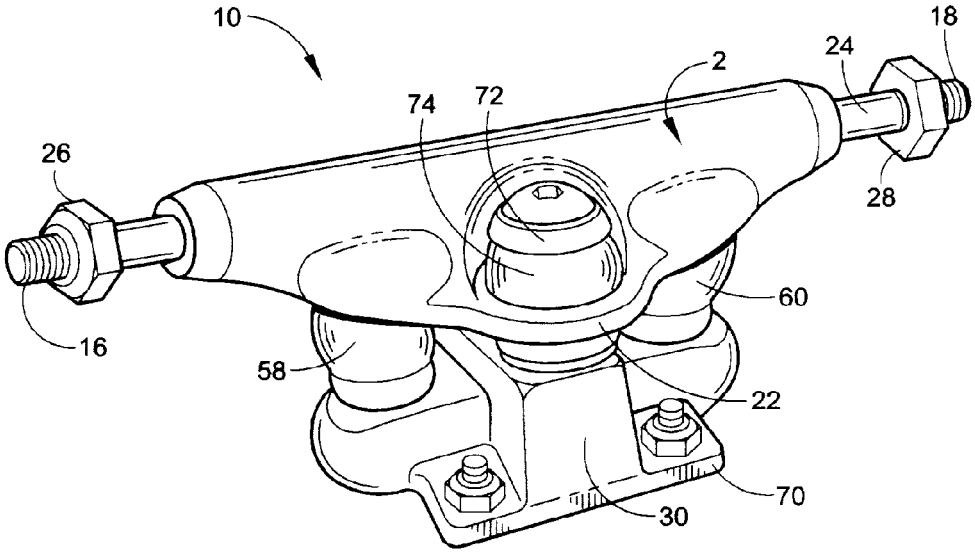
FIG. 1 is a rear perspective view of the Elastomer Suspension System skateboard truck showing our new design and structure thereof.
Figure 2:
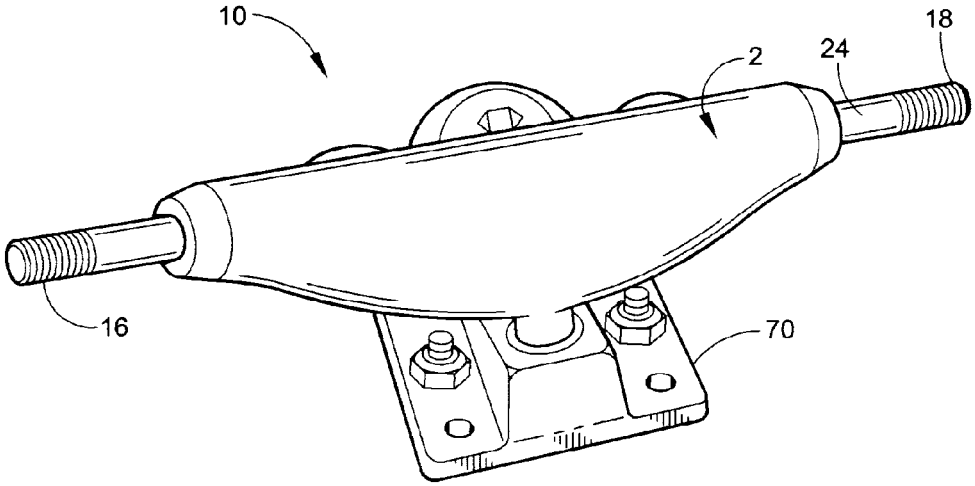
FIG. 2 is a front perspective view of the Elastomer Suspension System skateboard truck, showing our new design and structure thereof.
Figure 3:
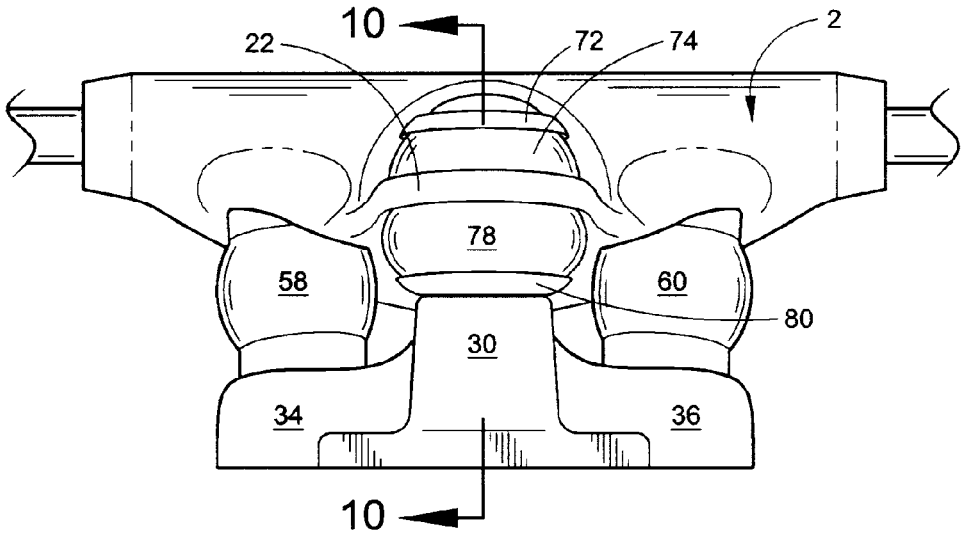
FIG. 3 is a rear view of the skateboard truck. This view depicts both constant rate compression elastomer shock absorbers and their attachment to the truck hanger and base, as well as, the pivot assembly utilizing constant rate compression elastomer bushings around the king pin thereof.
Figure 4:
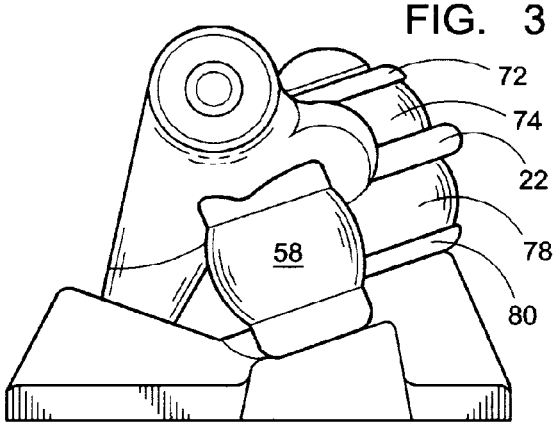
FIG. 4 is a right side view showing the elastomer shock absorber mounted between the truck hanger and truck base. This view further represents the pivot assembly utilizing elastomer bushings around the king pin thereof.
Figure 5:
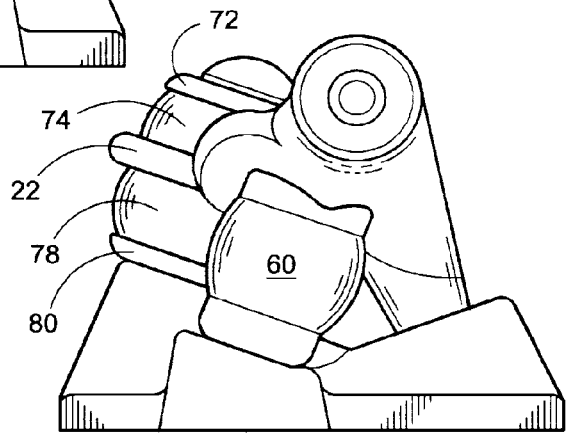
FIG. 5 is a left side view showing the elastomer shock absorber mounted between the truck hanger and the truck base This view further represents the pivot assembly utilizing elastomer bushings around the king pin thereof.
Figure 6:
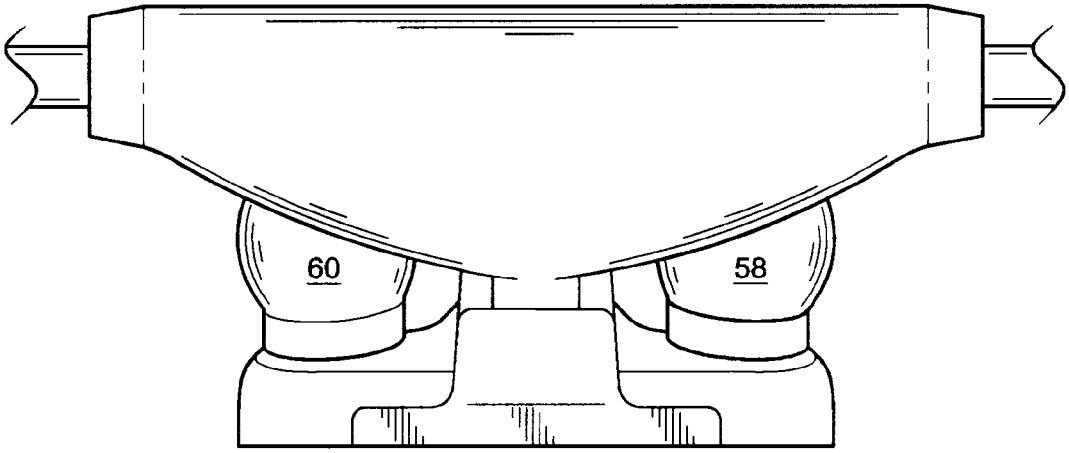
FIG. 6 is a front view of the skateboard truck delineating the connection of the elastomer shock absorbers between the skateboard truck hanger and the base plate thereof.
Figure 7:
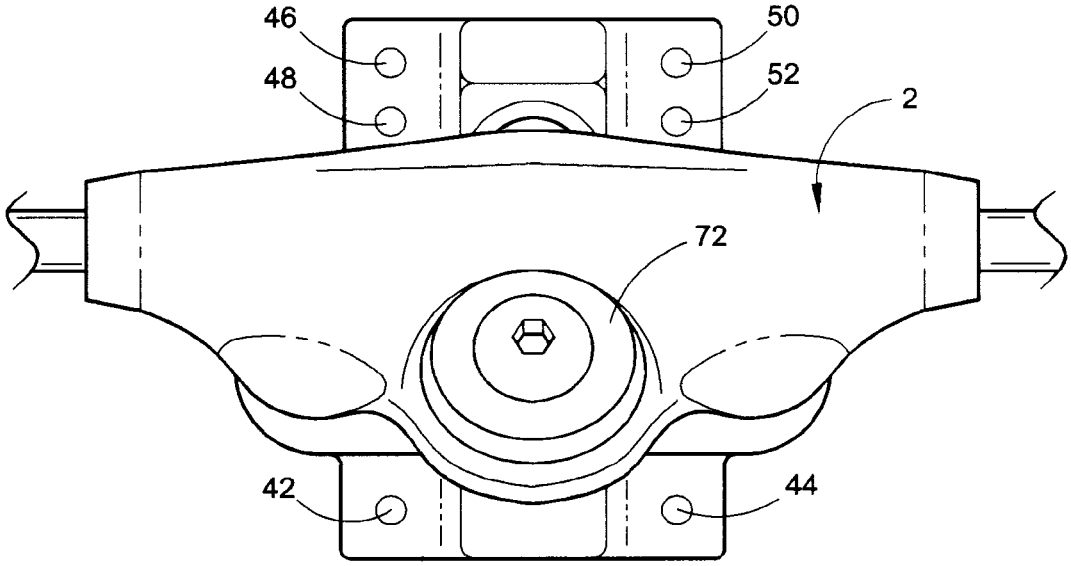
FIG. 7 is a top view of the skateboard truck thereof.
Figure 8:
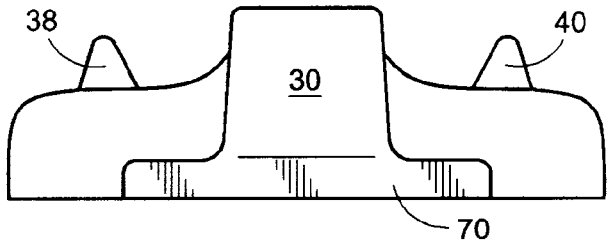
FIG. 8 is a rear view of the skateboard truck base plate outlining the orientation of the conically shaped shock absorber mounting studs thereof.
Figure 9:
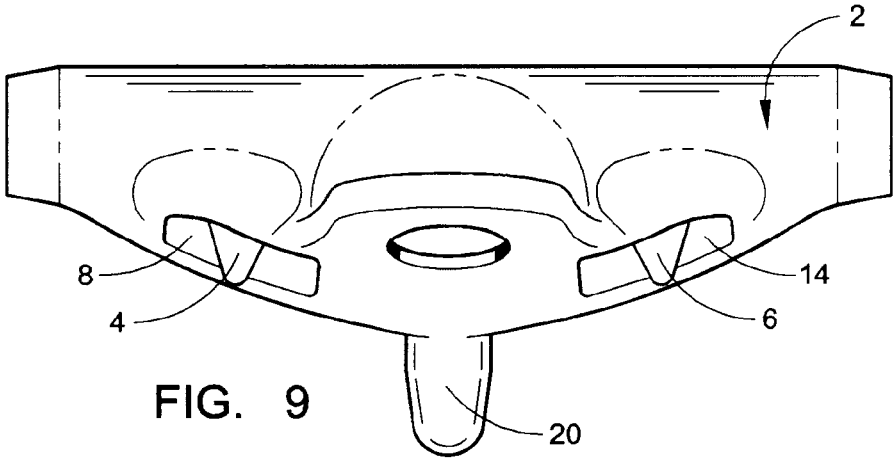
FIG. 9 is a rear view of the skateboard truck hanger, which portrays the elastomer shock absorbers mounting studs and the hanger pivot post thereof.
Figure 10:
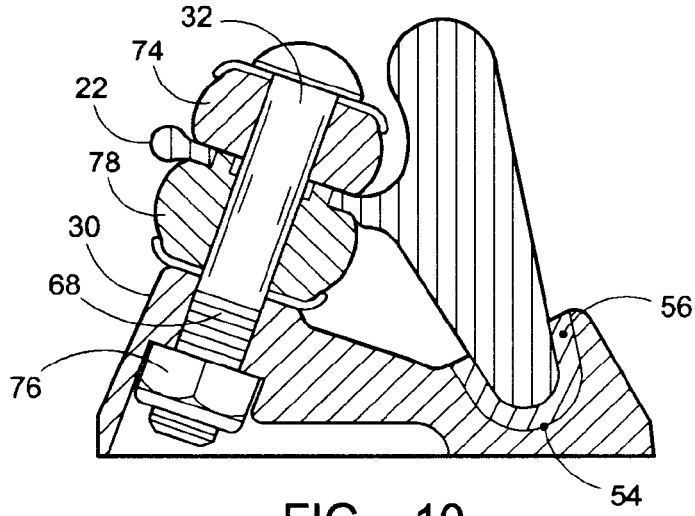
FIG. 10 is a cross sectional view of the left side of the skateboard truck renders both elastomer bushings secured by the king pin and hex nut, forming the pivot assembly between the skateboard truck hanger and truck base plate thereof.
Figure 11:
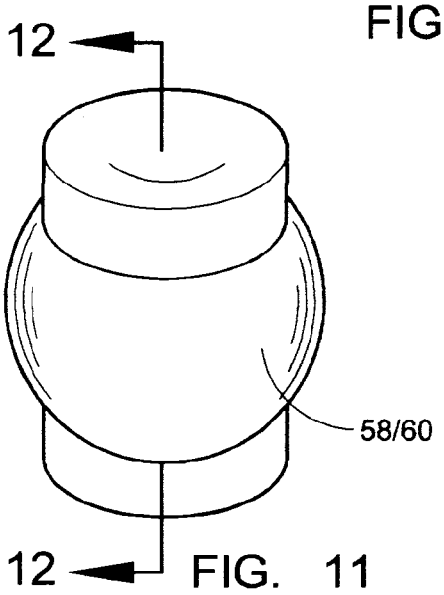
FIG. 11 is a perspective view of the constant rate compression shock absorber thereof.
Figure 12:
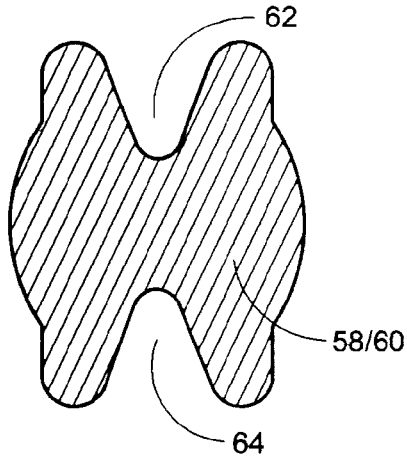
FIG. 12 is a cross sectional view of the elastomer shock absorber showing both conically shaped shock absorber mounting orifices.

The following is the detailed fabrication narrative of the Elastomer Suspension System Skateboard Truck. The truck is for attachment and use on all standard skateboard decks. This skateboard truck differs by all previous designs of skateboard trucks, by incorporating an easily interchangeable elastomer suspension system. This elastomer suspension system substantially reduces or eliminates the extreme impact shock forces related to all types of skateboarding. In addition, the elastomer suspension system provides enhanced control and maneuverability of the skateboard. Elastomer shock absorbers of various hardness, or density, can easily be interchanged to provide optimization of truck response according to a rider's weight and ability.

The skateboard truck hanger shall be cast from aluminum or other suitable metallurgical alloy. The hanger includes the fundamental body (2), which has raised conically shaped shock absorber mounting studs (4)(6) that are central to the circular recessed elastomer shock absorber retention cutouts (8)(14), which are opposite and equidistant from one another. Non-slipping axle (24) with extended axle terminal end studs (16)(18), pivot post (20) extending perpendicular the fundamental body (2). A semicircular through-holed aperture yoke (22), extending radial and perpendicular to the horizontal axis of the posterior side of the fundamental body (2) of the hanger, for means of mounting both top (78) and bottom (74) elastomer shock absorbing bushings, providing a pivot joint for the hanger assembly and securing the hanger to the base plate (70).

The skateboard truck axle (24) shall be machined from various metallurgical alloys and orientated central to the horizontal axis of the fundamental body (2) of the hanger. The axle terminal end studs (16)(18) shall be die threaded to accommodate skateboard wheels and secured by means of hexagonal jam lug nuts (26)(28).

The skateboard truck base plate (70) shall consist of a raised cast through-holed attachment socket (30) where the king pin (32) is inserted through for means of attaching and securing the hanger to the base plate. Cutouts will be cast into the base plate directly under the elevated elastomer shock absorber mounting platforms (34)(36) to reduce excess mass to the base plate. Opposite and equidistant on each elevated elastomer shock absorber mounting platform, shall be one each of a raised conically shaped elastomer shock absorber mounting studs (38)(40). Through-holes shall be machined drilled in each corner of the base plate, with one in each corner of the posterior end of the base plate (42)(44) and two in each corner of the anterior end of the base plate (46)(48)(50)(52) to facilitate attachment of the base plate and truck assembly to a skateboard deck. In the center posterior portion of the base plate is a recessed socket (54), inserted with an elastomer cup (56), providing a pivot joint on which the pivot post of the hanger will rotate.

The skateboard truck will employ two elastomer shock absorbers (12) and will be fabricated from various densities of elastomers to facilitate customization of the suspension system. The elastomer shock absorbers are cylindrical along their vertical axis and being spherically formed at the midpoint (58)(60). They are opened at either end with mounting orifices (62)(64), which makes possible the mounting and securing the elastomer shock absorbers to the raised conically shaped elastomer shock absorber mounting studs (4)(6)(38)(40) of both the skateboard truck hanger and the base plate.

The king pin (32) shall be a button head cap screw of standard size and produced from suitable metallurgical materials. One end of the king pin will be die threaded to secure the skateboard truck assembly (68) to the skateboard truck base plate (70) by means of a hexagonal jam nut (76). The king pin (32) is inserted all the way through the bottom elastomer bushing retention washer (72) bottom elastomer shock absorbing bushing (74), semicircular through-holed aperture yolks (22), top elastomer shock absorbing bushing (78) top elastomer bushing retention washer (80), and finally through the raised through-holed attachment socket (30) where the die threaded end (68) will be secured by the hexagonal jam nut (76) flush with the anterior side of the base plate (70).

The Elastomer Suspension System Skateboard Truck is now fully assembled (10) and ready to be mounted to a skateboard deck.

What is claimed is:

1. An elastomer suspension system wheel truck for a skateboard comprising:

a base plate adapted for attachment to the underside of a skateboard deck with a centerline in parallel with the longitudinal centerline of the skateboard, and having two shock absorber mounting platforms, each platform located on opposite sides of and equidistant from the centerline of the base plate, wherein each of the mounting platforms consists of a single, raised conically-shaped stud for securing an elastomer shock absorber to the base plate and, a hanger including a fundamental body with a semicircular through-holed aperture yoke, the hanger having a centerline and a single axle extending transversely to the hanger centerline and including threaded end portions extending outward from the terminal ends of the hanger, being adapted for attaching wheels; and further comprising, a pivot fastener insertable through a through-hole of the aperture yoke and into the base plate for attaching the hanger to the base plate, and further comprising, two elastomer shock absorbers, each having cylindrically-shaped opposite end portions and being spherically-shaped there between, and having conically-shaped openings in each of the opposite end portions, the shock absorbers being adapted for attaching one of the ends to the hanger and the opposite end to the base plate.

2. The elastomer suspension system wheel truck of claim 1, in which on the dorsal surface of the hanger bilateral and equidistant from the center line of the semicircular through-holed aperture yoke of the hanger are single, raised, cast, conically-shaped shock absorber mounting studs central to the elastomer shock absorber, for the purpose of attaching and securing the elastomer shock absorbers to the hanger.

* * * * *